US005361545A

United States Patent [19]

Nakamura

[11] Patent Number: 5,361,545

[45] Date of Patent: Nov. 8, 1994

[54] POLISHING MACHINE

[75] Inventor: Yoshio Nakamura, Nagano, Japan

[73] Assignee: Fujikoshi Kikai Kogyo Kabushiki Kaisha, Nagano, Japan

[21] Appl. No.: 105,534

[22] Filed: Aug. 11, 1993

[30] Foreign Application Priority Data

Aug. 22, 1992 [JP] Japan ..... 4-245785

[51] Int. Cl.[5] ..... B24B 7/22; B24B 37/04

[52] U.S. Cl. ..... 451/287; 901/17; 451/290

[58] Field of Search ..... 51/131.4, 133, 215 R, 51/131.1, 131.3; 901/17, 40, 22

[56] References Cited

U.S. PATENT DOCUMENTS 3,834,557 9/1974 Devillers ..... 901/17

5,059,089 10/1991 Kocaoglan ..... 901/17

FOREIGN PATENT DOCUMENTS 4053674 2/1992 Japan .

*Primary Examiner*—Robert A. Rose

*Attorney, Agent, or Firm*—Jordan and Hamburg

[57] ABSTRACT

The polishing machine of the present invention is capable of moving a work away from a center roller and a guide roller without reference to other members. In the polishing machine, a circular polishing plate is capable of revolving so as to polish works. A center roller is capable of revolving. Guide rollers are arranged around the center roller and capable of revolving, wherein each work is rotatably held between each guide roller and the center roller. An arm shaft is provided in the vicinity of the polishing plate and capable of moving in the longitudinal direction. A work head is provided to the arm shaft and capable of holding and releasing the work. A driving mechanism moves the arm shaft so as to move the work head between a discharge position and a specified position. A releasing mechanism slightly moves the arm shaft in the longitudinal direction so as to slightly move the work away from the center roller and the guide roller.

11 Claims, 6 Drawing Sheets

POLISHING MACHINE

BACKGROUND OF THE INVENTION

The present invention relates to a polishing machine, more precisely, it relates to a polishing machine, which has a polishing plate for polishing works; a center roller being coaxial to the polishing plate, a plurality of guide rollers arranged around the center roller for rotatably holding the works with the center roller; and an arm shaft having a work head for holding and releasing the work so as to transfer the work.

Conventionally, a polishing machine, for example, for polishing silicon wafers (works) is known. One conventional polishing machine is disclosed in the Japanese Patent Kokai Gazette No. 4-53674. The disclosed polishing machine has a circular polishing plate, which is capable of revolving so as to polish silicon wafers. A center roller is rotatably provided at a center of the polishing plate. A plurality of guide rollers are rotatably arranged around the center roller with regular intervals. The circular silicon wafers are respectively adhered on one face of each carrying plate, and each carrying plate is rotatably held between an outer circumferential face of each guide roller and that of the center roller. An arm shaft is provided between two adjoined polishing machines, and moved in the longitudinal direction by an air cylinder unit. A work head, which is capable of holding and releasing the carrying plate with the wafer, is provided at a front end of the arm shaft. The work head is capable of moving between a discharge position on the polishing plate of one of the polishing machines and a supplying position on a polishing plate of the other polishing machine.

However, the conventional polishing machine has a following disadvantage.

When the carrying plate with the wafer is discharged from the discharge position of the one polishing machine, the carrying plate, which was held between the center roller and the guide roller, must be moved away from the center roller and the guide roller. If the carrying plate, which is held by the center roller and the guide roller, is lifted by the work head, the wafer may be caught and damaged by the center roller and the guide roller. To avoid the damage, the conventional polishing machine has an air cylinder unit, which moves the arm shaft in the longitudinal direction so as to move the carrying plate away from the center roller and the guide roller before lifting the carrying plate. After the arm shaft is moved in the longitudinal direction by the air cylinder unit, the arm shaft is turned to transfer the carrying plate to the supplying position of the adjacent polishing machine.

To move the carrying plate away from the center roller and the guide roller and to turn the arm shaft with the work head so as to transfer the carrying plate to the adjacent polishing machine, the arm shaft is moved in the longitudinal direction, so that a stroke of the movement of the arm shaft should be relatively longer. With the longer stroke of the arm shaft, in some cases based on positions of the arm shaft, the arm shaft interferes with other carrying plates or other members. Therefore, the position or the design of the arm shaft is limited.

SUMMARY OF THE INVENTION

An object of the present invention is to provide a polishing machine whose arm shaft is capable of moving a work away from a center roller and a guide roller without reference to other members.

To achieve the object, the polishing machine of the present invention comprises:

a circular polishing plate being capable of revolving so as to polish works;

a center roller being coaxial to the polishing plate, the center roller being capable of revolving;

a plurality of guide rollers being arranged around the center roller with regular intervals, the guide rollers being capable of revolving, wherein each work is rotatably held between an outer circumferential face of each guide roller and an outer circumferential face of the center roller;

an arm shaft being provided in the vicinity of the polishing plate, the arm shaft being capable of moving in the longitudinal direction;

a work head being provided at a front end of the arm shaft, the work head being capable of holding and releasing the work;

a driving mechanism moving the arm shaft so as to move the work head between a discharge position, at which the works are discharged, on the polishing plate and a specified position, to which the works are transferred, outside of the polishing plate; and a releasing mechanism slightly moving the arm shaft in the longitudinal direction so as to slightly move the work, which has been held by the work head and held between the center roller and the guide roller at the discharge position, away from the center roller and the guide roller when the work is discharged from the polishing plate.

In the polishing machine of the present invention, the releasing mechanism slightly moves the arm shaft in the longitudinal direction so as to slightly move a work away from the center roller and the guide roller when the work is discharged from the polishing plate. Thus the moving distance of the arm shaft can be very short when the work is moved away therefrom. And the discharge position can be assigned to anywhere on the polishing plate without interfering with the arm shaft.

BRIEF DESCRIPTION OF THE DRAWINGS

An embodiment of the present invention will now be described by way of an example and with reference to the accompanying drawings, in which.

DETAILED DESCRIPTION OF THE PREFERRED EMBODIMENT

A preferred embodiment of the present invention will now be described in detail with reference to the accompanying drawings. Note that, a polishing machine for polishing silicon wafers, which is an example of works, will be explained in the present embodiment.

Figure 1:
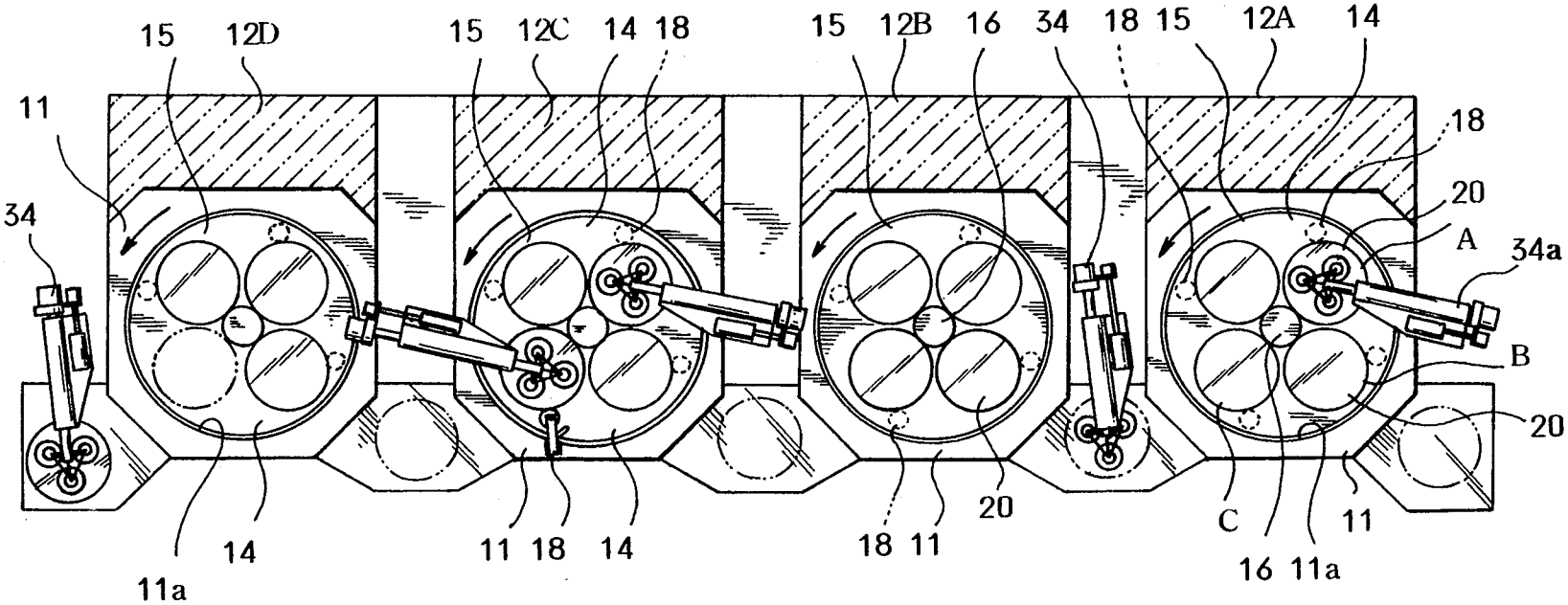
FIG. 1 is a plan view showing a polishing line having polishing machines of the present invention.
Figure 2:
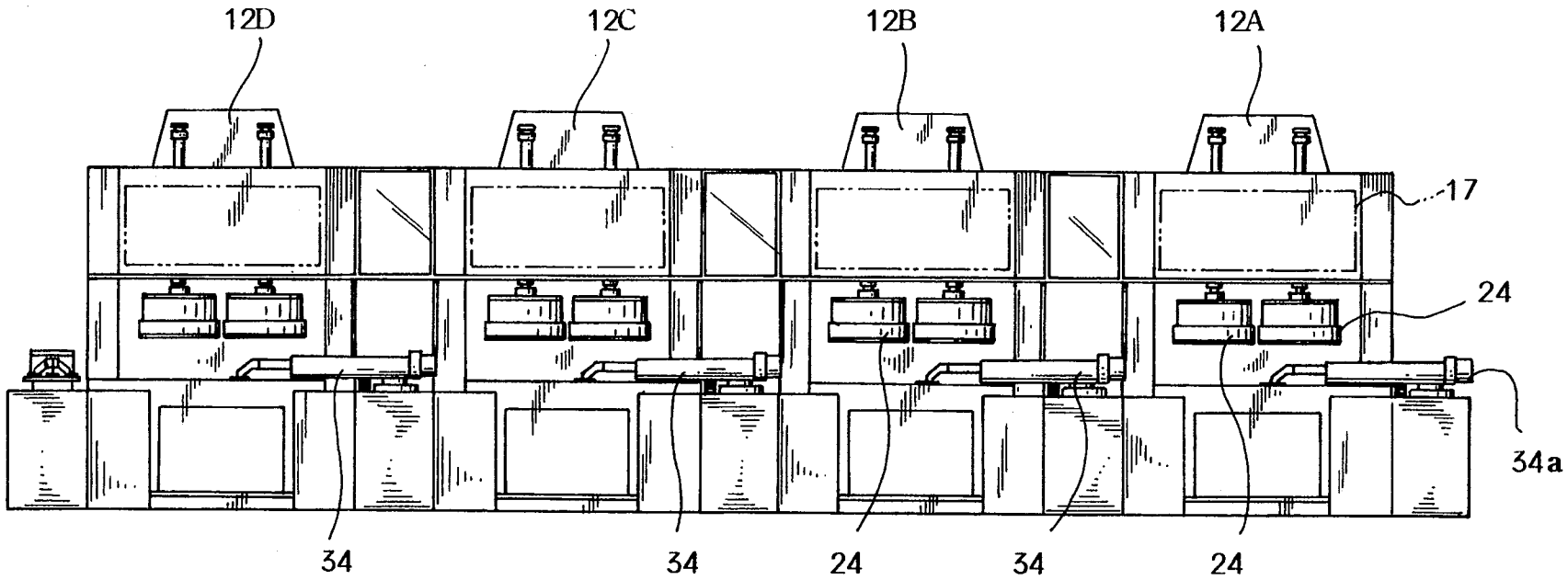
FIG. 2 is a front view of the polishing line.

FIG. 1 is a plan view showing a polishing line having polishing machines of the present invention, and FIG. 2 is a front view of the polishing line shown in FIG. 1.

The polishing line of the embodiment has four polishing machines 12A, 12B, 12C and 12D, which are respectively assigned for first polishing, second polishing, third polishing and final polishing in that order. The polishing machines 12A, 12B, 12C and 12D are linearly arranged. The polishing machines 12A, 12B, 12C and 12D have polishing cloth for polishing the wafers, and slurry is supplied to the polishing cloth while the wafers are polished. So roughness of the polishing cloth and grain size of the slurry gradually become finer in order of the first polishing to the final polishing.

Each polishing machine 12A, 12B, 12C and 12D has a base 11 having a concave section 11*a* in which a circular polishing plate 14 is rotatably provided. The polishing plates 14 are revolved by driving means (not shown). The polishing cloth 15 is adhered on an upper face of each polishing plate 14 (see FIG. 3).

There are provided center rollers 16, which are freely rotatable, at a center of each polishing plate 14.

There are provided guide rollers 18, which are freely rotatable, alongside and above an edge of each polishing plate 14. In the present embodiment, Four guide rollers 18 are arranged around the center roller 16 in regular intervals. Circular carrying plates 20 for holding the wafers will be respectively held between an outer circumferential face of the center roller 16 and an outer circumferential face of each guide roller 18. The wafer 22 is adhered on a bottom face of the carrying plate with wax (See FIG. 3).

Each carrying plate 20, which has been held between the center roller 16 and the guide roller 18, will be pressed down by a top presser 24. The top pressers 24 are suspended, and capable of revolving and vertically moving. Weights for pressing the carrying plates 20 with the wafers 22 downward are respectively accommodated in each top presser 24, so that bottom faces of the wafers 22 are pressed onto the polishing cloth 15.

Note that, the weights are gradually lightened in order of the polishing machines 12A, 12B, 12C and 12D.

In each polishing machine 12A, 12B, 12C and 12D, even if the polishing plate 14 revolves, the carrying plate 20 is prevented from moving in the circumferential direction of the polishing plate 14 because the carrying plate 20 is held between the center roller 16 and the guide roller 18. Note that, the guide rollers 18 are shown as dotted lines in FIG. 1.

In the revolving polishing plate 14, angular speed of an edge section is different from that of a center section, so the speed difference causes the carrying plates 20 on the revolving polishing plate 14 and the top pressers 24 pressing the carrying plates 20 to revolve between the center roller 16 and the guide rollers 18.

While the carrying plates 20 revolve, the slurry is supplied to the polishing cloth, so that the bottom faces of the wafers 22, which are adhered on the bottom faces of the carrying plates 20, are polished.

Figure 3:
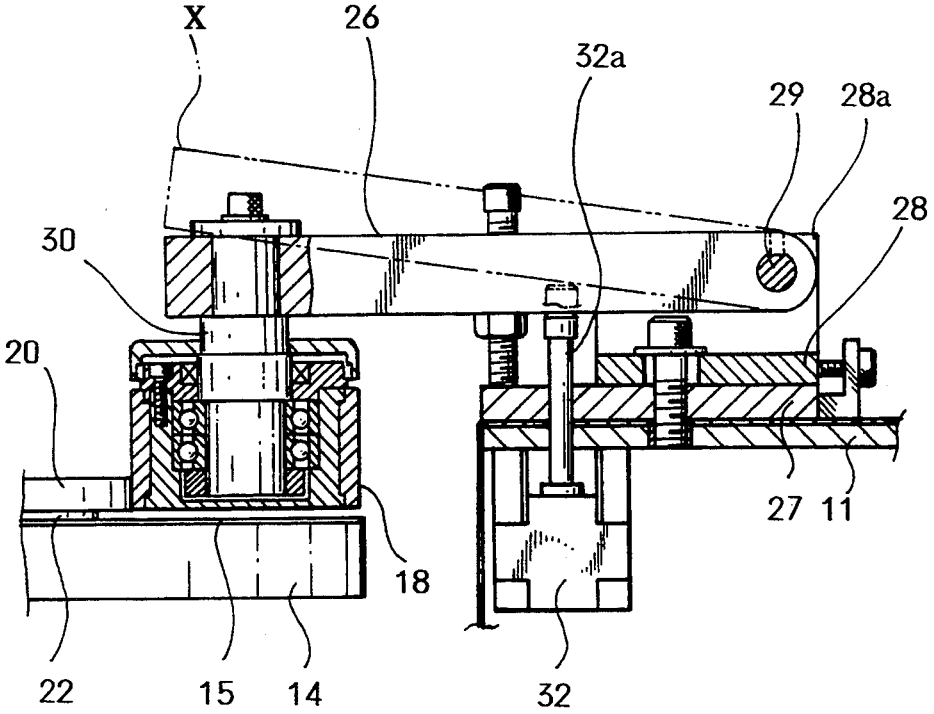
FIG. 3 is a sectional view of a guide roller of the polishing machine.
Figure 4:
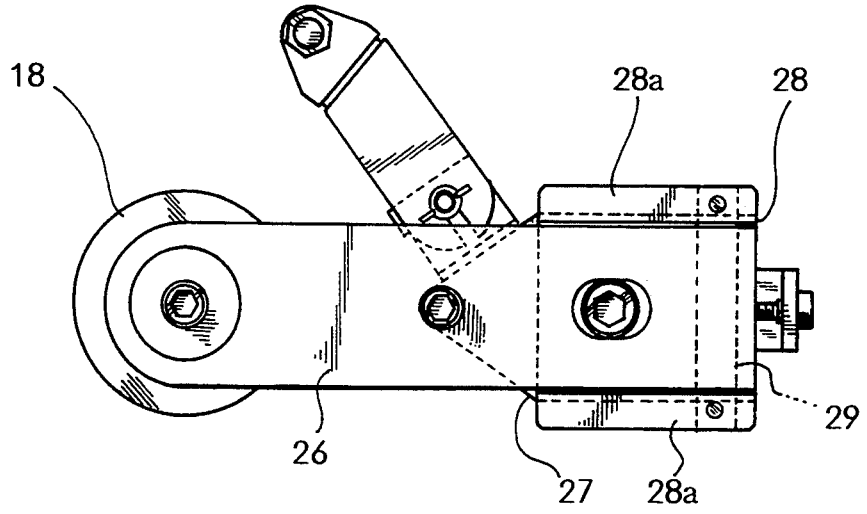
FIG. 4 is a plan view of the guide roller shown in FIG. 3.

Next, the guide roller 18 will be explained with reference to FIGS. 3 and 4.

The guide roller 18 is provided alongside and above the edge of the polishing plate 14. The guide roller 18 is rotatably suspended at a front end of a hanging arm 26. A rear end of the hanging arm 26 is extended toward the base 11. A fixed base 27 is fixed on the base 11. There is provided a U-shaped base plate 28, whose position with respect to the polishing plate 14 can be precisely adjusted, on the fixed base 27. The rear end of the hanging arm 26 is located between side plates 28*a* and 28*a* of the base plate 28 and rotatably attached by a shaft 29. The shaft 29 is parallel to the base 11.

A shaft 30 is vertically provided at the front end of the hanging arm 26. The guide roller 18 is rotatably provided on a lower end of the shaft 30 with a ball bearing.

A front end of a cylinder rod 32*a* of an air cylinder unit 32, which is provided in the base 11, contacts a bottom face of a mid section of the hanging arm 26. With this structure, when the cylinder rod 32*a* is extended upward, the hanging arm 26 turns on the shaft 29 as shown by two-dotted chain lines X in FIG. 3, so that the guide roller 18 is moved away from the polishing plate 14.

When the hanging arm 26 is in a horizontal state or the guide roller 18 is at the lowest position, the carrying plate 20 can be held between the center roller 16 and the guide roller 18. The lowest position of the guide roller 18 is referred to as a holding position. On the other hand, when the front end of the hanging arm 26 is moved upward by extending the cylinder rod 32*a* of the cylinder unit 32 (see the two-dotted chain lines X in FIG. 3), the guide roller 18 is moved away from the polishing plate 14. The position separated away from the polishing plate 14 is referred to as a free position. If the guide roller 18 is in the free position, the carrying plate 20 is not held between the center roller 16 and the guide roller 18, so that the carrying plate 20 moves in the circumferential direction together with the polishing plate 14.

There are provided transferring units 34 between the adjacent polishing machines 12A and 12B, 12B and 12C, and 12C and 12D, and on the left side of the polishing machine 12D. And there is provided a transferring unit 34*a* on the right side of the polishing machine 12A.

Next, the transferring unit 34 will be explained with reference to FIGS. 5 and 6. Note that, structure of the transferring unit 34*a* is the same as that of the transferring unit 34 so explanation of the transferring unit 34*a* will be omitted.

Figure 5:
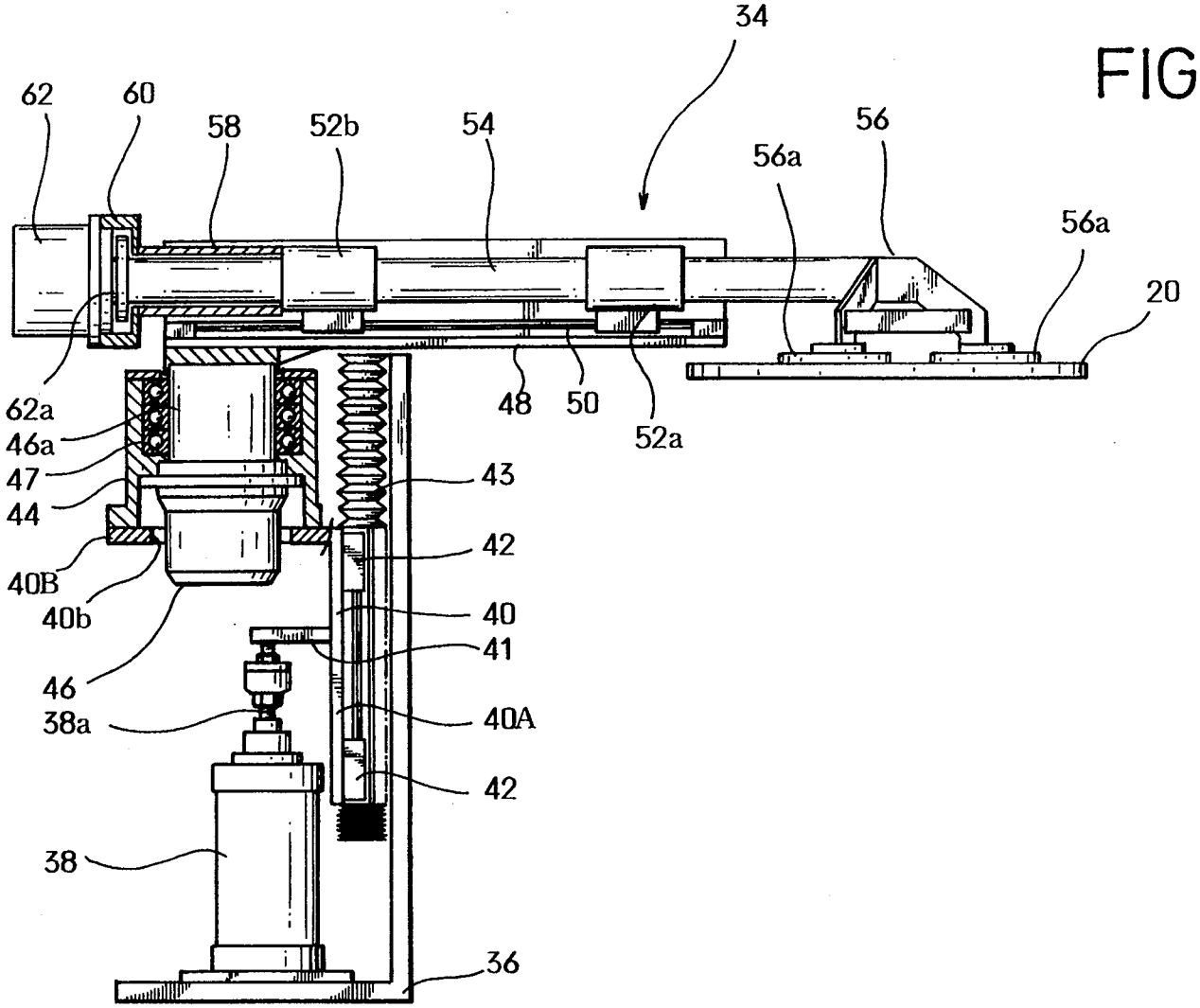
FIG. 5 is a sectional view of a transferring unit of the polishing machine.
Figure 6:
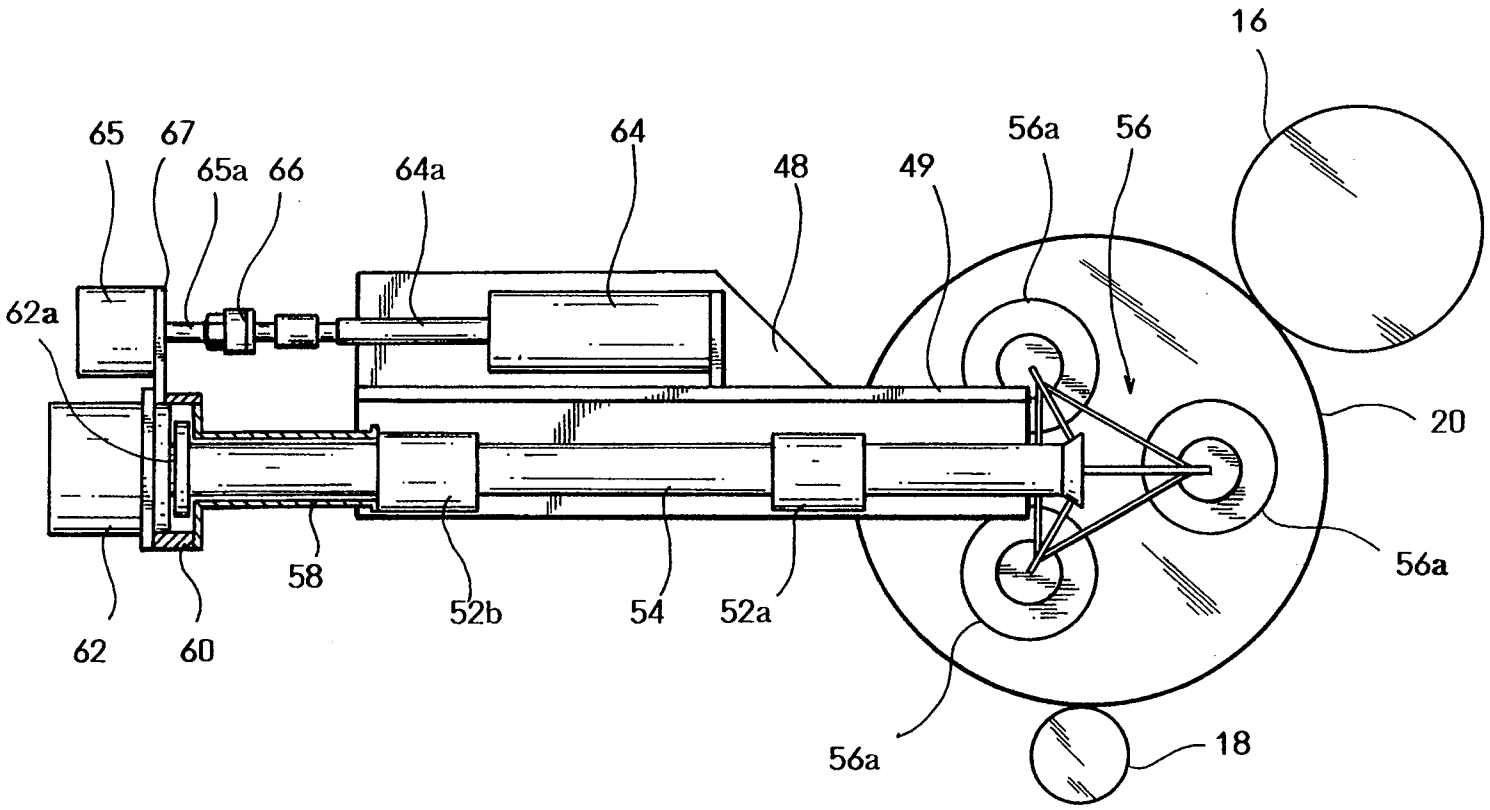
FIG. 6 is a plan view of the transferring unit shown in FIG. 5.

In FIG. 5, an air cylinder unit 38, which is an example of an elevating mechanism, is provided on a base 36. A cylinder rod 38*a* of the cylinder unit 38 is connected to an elevating frame 40 by a connecting member 41. The elevating frame 40 is formed into an inverted L-shape with a vertical section 40A and a horizontal section 40B. The connecting member 41 is attached to an inner face of a mid section of the vertical section 40A. And there are provided sliding members 42 and 42 on an outer face of the vertical section 40A. The sliding members 42 and 42 are slidably engaged with a guide 43. Thus, the elevating frame 40 is capable of vertically moving along the guide 43.

There is bored a through-hole 40*b* in a center part of the horizontal section 40B of the elevating frame 40. And there is fixed a casing 44 on an upper face thereof. A motor 46, which is an example of first rotational driving means, is fixed below the casing 44. A motor shaft 46*a* of the motor 46 is rotatably inserted in a bearing 47, which is fixed in the casing 44.

An arm base 48 is fixed to a front end of the motor shaft 46*a* of the motor 46. Thus, the motor 46 rotates the arm base 48 together with the motor shaft 46*a*.

There is provided a partition 49 on a center part of the arm base 48. On the arm base 48, a guide rail 50 is provided on one side of the partition 49. Sliders 52*a* and 52*b* are slidably attached on the guide rail 50. An arm shaft 54 is pierced through the sliders 52*a* and 52*b*. There is provided a work head 56 at a front end of the arm shaft 54. The arm shaft 54 is supported by the sliders 52*a* and 52*b*, and capable of rotating on the axis line.

The work head has three vacuum pads 56*a*, which are arranged like an equilateral triangle. The vacuum pads 56*a* are connected to a vacuum generator (not shown) so as to suck the carrying plate 20 with the wafer 20.

A housing 60 is fixed to the slider 52*b* with a connecting cylinder 58. There is fixed a motor 62, which is an example of second rotational means, at rear end of the housing 60. A motor shaft 62*a* of the motor 62 is connected to the arm shaft 54. Thus, the motor 62 rotates the arm shaft 54 on the axial line together with the motor shaft 62*a*. By rotating the arm shaft 54, a polished face of the wafer 20 held by the work head 56 can be visually examined by an operator.

A first air cylinder unit 64, which constitutes a driving mechanism, is fixed on the other side of the partition 49 on the arm base 48. A cylinder rod 64*a* of the first cylinder unit 64 is capable of extending backward. A front end of the cylinder rod 64*a* is connected to a front end of a cylinder rod 65*a* of a second air cylinder unit 65, which is an example of a releasing mechanism, by a connecting member 66. The stroke of the cylinder rod 65*a* is quite shorter than that of the cylinder rod 64*a*. The second air cylinder unit 65 is fixed to the housing 60 by a connecting member 67.

When the first air cylinder unit 64 is driven, the arm shaft 54 and the housing 60 are moved with a relatively long distance in the longitudinal direction of the arm shaft. On the other hand, when the second air cylinder unit 65 is driven, the arm shaft 54 and the housing 60 are slightly moved in the same direction.

In the transferring unit 34, the motor 46, the arm base 48, the arm shaft 54, the air cylinder units 64 and 65, etc., which are provided to the elevating frame 40, are vertically moved by driving the air cylinder unit 38.

The motor 46 turns the arm shaft 54, etc. on the arm base 48. The arm shaft 54 is turned between at least a first angular position, at which the work head 56 heads for the discharge position on the polishing plate 14, and a second angular position, at which the work head 56 heads for the supplying position of the polishing plate of the adjacent polishing machine.

Figure 7:
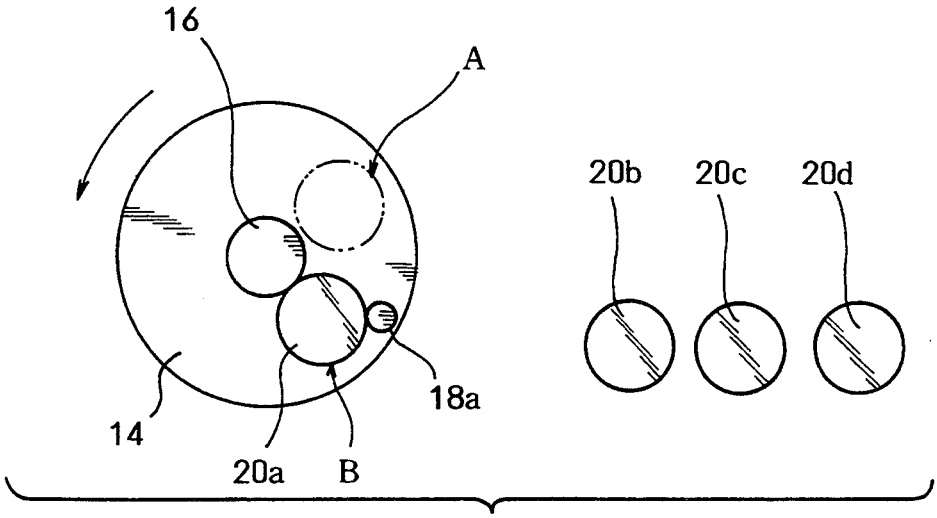
FIG. 7 is an explanation view showing a state of supplying a carrying plate onto a polishing plate.
Figure 8:
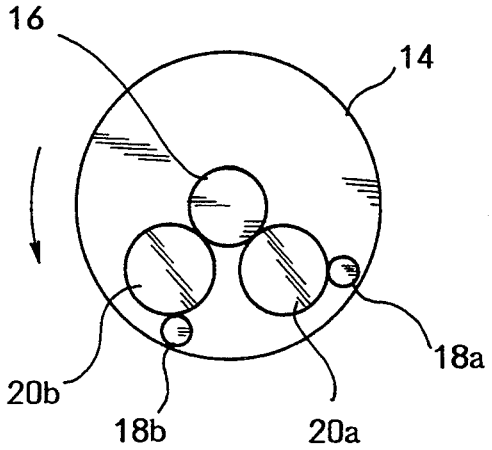
FIG. 8 is an explanation view showing a state of supplying a carrying plate onto a polishing plate.
Figure 9:
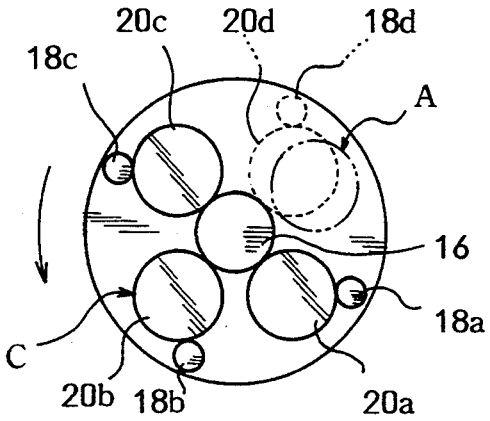
FIG. 9 is an explanation view showing a state of supplying a carrying plate onto a polishing plate.

Successively, a method of supplying the carrying plates 20 with the wafers 22 to, for example, the polishing machine 12A will be explained with reference to FIGS. 7–9.

Note that, in the polishing machine 12A, the carrying plate 20 with the wafer 22 is supplied to the polishing plate 14 from the right side. A position A on the polishing plate 14 is a supplying position of the carrying plate 20.

(1) The polishing plate 14 is revolved in the counterclockwise direction. A guide roller 18*a*, which is arranged next to the position A, is moved to the holding position.

A first carrying plate 20*a* with the wafer 22 is supplied onto the supplying position A on the polishing plate 14 by the transferring unit 34*a*. Then the first polishing plate 20*a* is moved in the counterclockwise direction together with the polishing plate 14 until the first carrying plate 20*a* is held between the center roller 16 and the guide roller 18*a* (see FIG. 7).

(2) A guide roller 18*b*, which is arranged next to the guide roller 18*a*, is moved to the holding position.

A second carrying plate 20*b* with the wafer 22 is supplied onto the supplying position A on the polishing plate 14 by the transferring unit 34*a*. Then the second polishing plate 20*b* is moved in the counter-clockwise direction together with the polishing plate 14 until the second carrying plate 20*b* is held between the center roller 16 and the guide roller 18*b* (see FIG. 8).

(3) A guide roller 18*c*, which is arranged next to the guide roller 18*b*, is moved to the holding position.

A third carrying plate 20*c* with the wafer 22 is supplied onto the supplying position A on the polishing plate 14 by the transferring unit 34*a*. Then the third polishing plate 20*c* is moved in the counter-clockwise direction together with the polishing plate 14 until the third carrying plate 20*c* is held between the center roller 16 and the guide roller 18*c* (see FIG. 9).

(4) A guide roller 18*d*, which is arranged next to the guide roller 18*c*, is moved to the holding position.

A fourth carrying plate 20*d* with the wafer 22 is supplied onto the supplying position A on the polishing plate 14 by the transferring unit 34*a*. Then the fourth polishing plate 20*d* is moved in the counter-clockwise direction together with the polishing plate 14 until the fourth carrying plate 20*d* is held between the center roller 16 and the guide roller 18*d* (see FIG. 9).

Above described steps (1)–(4) are controlled by controllers 17, which are provided above the polishing machines.

Next, a method of discharging the carrying plates 20 with the wafers 22, for example, from the discharge position of the polishing machine 12A to the adjacent polishing machine 12B will be explained with reference to FIG. 9.

Note that, in the polishing machine 12A, a position C on the polishing plate 14 is the supplying position.

[1] The elevating frame 40 is moved upward by driving the air cylinder unit 38 of the transferring unit 34. Upon the elevating frame 40 reaching the uppermost position, the motor 46 rotates the arm base 48 and the cylinder rod 64*a* of the first air cylinder unit 64 is extended. At that time, the cylinder rod 65*a* of the second air cylinder unit 65 is retracted.

When the cylinder rod 64*a* is extended, the work head 56 is moved over the carrying plate 20*b*.

The elevating frame 40 is moved downward by driving the air cylinder unit 38 so as to suck the carrying plate 20*b* by the vacuum pads 56*a* of the work head 56. Upon sucking the carrying plate 20*b* by the vacuum pads 56*a*, the cylinder rod 65*a* of the second air cylinder unit 6D is extended so as to slightly slide the carrying plate 20*b* on the polishing plate 14. By sliding the carrying plate 20*b*, the carrying plate 20*b*, which has been held by the work head 56 and held between the center roller 16 and the guide roller 18*b*, is released from the center roller 16 and the guide roller 18*b*.

Next, the elevating frame 40 is moved upward by driving the air cylinder unit 38. And the motor 46 turns the arm shaft 54 to a position at which no members interfere the arm shaft 54. Furthermore, whine the arm shaft 54 is turned, the cylinder rod 64*a* of the first air cylinder unit 64 is driven with the longer stroke in order to discharge and transfer the carrying plate 20*b* to the position over the supplying position A of the adjacent polishing machine 12B. Then the elevating frame 40 is moved downward by driving the air cylinder unit 38 so as to set the carrying plate 20*b* onto the supplying position A. Upon the carrying plate 20*b* setting onto the position A, the vacuum pads 65*a* release the carrying plate 20*b*.

[2] The guide roller 18*c* of the polishing machine 12A is moved to the free position. Then the carrying plate 20*c* is moved in the counterclockwise direction, together with the polishing plate 14, until the carrying plate 20*c* is held between the center roller 16 and the guide roller 18*b*.

While the carrying plate 20*c* is held between the center roller 16 and the guide roller 18*b*, the carrying plate 20*c* is discharged and transferred to the polishing machine 12B by the transferring unit 34.

[3] The guide roller 18*d* of the polishing machine 12A is moved to the free position. Then the carrying plate 20*d* is moved in the counterclockwise direction, together with the polishing plate 14, until the carrying plate 20*d* is held between the center roller 16 and the guide roller 18*b*.

While the carrying plate 20*d* is held between the center roller 16 and the guide roller 18*b*, the carrying plate 20*d* is discharged and transferred to the polishing machine 12B by the transferring unit 34.

[4] The guide roller 18*a* of the polishing machine 12A is moved to the free position. Then the carrying plate 20*a* is moved in the counterclockwise direction, together with the polishing plate 14, until the carrying plate 20*a* is held between the center roller 16 and the guide roller 18*b*.

While the carrying plate 20*a* is held between the center roller 16 and the guide roller 18*b*, the carrying plate 20*a* is discharged and transferred to the polishing machine 12B by the transferring unit 34.

Above described steps [1]–[4] are also controlled by the controllers 17.

Like as described above, the carrying plates 20 with the wafers 22 are discharged and transferred to the polishing machines 12A–12D in order.

Polishing work for the wafers 22 adhered on the carrying plates 20 are completed in the polishing machine 12D, and the wafers 22 completed are discharged from the polishing machine 12D by the transferring unit 34.

In the present embodiment, when the carrying plate 20 with the wafer 20 is discharged from the polishing plate 14, firstly the second air cylinder unit 65 slightly moves the arm shaft 54 in the longitudinal direction, so that the carrying plate 20 with the wafer 22 is slightly moved away from the center roller 16 and the guide roller 18. Thus, the moving distance of the carrying plate 20 can be quite short. With this short movement, even if the carrying plate 20 is located at any positions on the polishing plate 14, the carrying plate 20 can be moved away from the center roller 16 and the guide roller without interference with other members. After the carrying plate 20 is moved away therefrom, the elevating frame 40 is moved upward and the arm shaft 54 is turned so as to prevent interferring with other members, Then the arm shaft 54 is moved in the longitudinal direction by the first air cylinder unit 64 with the longer stroke so as to discharge and transfer the carrying plate 20 to the adjacent polishing machine.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A polishing machine for polishing works, comprising:

a revolving circular polishing plate;

a revolving center roller coaxial to said polishing plate;

a plurality of revolving guide rollers arranged around said center roller at regular intervals, wherein each of said works is rotatably held between an outer circumferential face of each said guide roller and an outer circumferential face of said center roller;

an arm shaft provided in the vicinity of said polishing plate, means for moving said arm shaft in the longitudinal direction;

a work head at a front end of said arm shaft for holding and releasing said work;

a driving mechanism moving said arm shaft to move said work head between a discharge position, at which said works are discharged on said polishing plate, and a specified position to which said works are transferred outside of said polishing plate; and a releasing mechanism slightly moving said arm shaft in the longitudinal direction to slightly move said work, which has been held by said work head and held between said center roller and said guide roller at the discharge position, away from said center roller and said guide roller when said work is discharged from said polishing plate.

2. The polishing machine according to claim 1, wherein said driving mechanism includes a first air cylinder unit for moving said arm shaft in the longitudinal direction, and said releasing mechanism is a second air cylinder unit.

3. The polishing machine according to claim 2, wherein one of said first and second cylinder units is unmovably fixed, the other thereof is connected to said arm shaft, and rods of said first and second cylinder units are mutually connected.

4. The polishing machine according to claim 1, wherein said driving mechanism includes a first rotational driving means for turning said arm shaft between a first angular position, at which said work head moves to the discharge position, and a second angular position, at which said work head moves to the specified position.

5. The polishing machine according to claim 1, wherein the specified position is a supplying position on a polishing plate of an adjacent polishing machine

6. The polishing machine according to claim 1, wherein said arm shaft rotates about an axial line.

7. The polishing machine according to claim 6, further comprising a second rotational driving means for rotating said arm shaft.

8. The polishing machine according to claim 1, wherein said work head includes a vacuum pad.

9. The polishing machine; according to claim 1, further comprising an elevating means for moving said arm shaft in the vertical direction.

10. The polishing machine according to claim 9, wherein said elevating means is an air cylinder unit.

11. The polishing machine according to claim 1, wherein said work is a silicon wafer, which is adhered on a circular carrying plate, and said work head holds and releases said carrying plate with the silicon wafer.

* * * * *